US005490315A

United States Patent [19]

Kostopolos et al.

[11] Patent Number: 5,490,315

[45] Date of Patent: Feb. 13, 1996

[54] METHOD AND APPARATUS FOR CONTINUOUSLY HOT ROLLING STRIP

[75] Inventors: Peter Kostopolos; Giuseppe Facco, both of Pittsburgh, Pa.

[73] Assignee: Italimpianti of America, Inc., Coraopolis, Pa.

[21] Appl. No.: 181,761

[22] Filed: Jan. 21, 1994

[51] Int. Cl.[6] ..... B21B 1/46

[52] U.S. Cl. ..... 29/527.7; 29/33 C; 29/33 B; 228/158; 72/202; 432/122

[58] Field of Search ..... 228/158, 176, 228/265; 29/527.7, 335, 33 C, 33 B; 72/202; 164/417, 476; 432/121, 122

[56] References Cited

U.S. PATENT DOCUMENTS

| | | | |
|---|---|---|---|
| 2,533,605 | 12/1950 | Mueller | 29/33 B |
| 2,911,515 | 11/1959 | Cooper | 219/79 |
| 4,132,342 | 1/1979 | Nitto et al. | 228/158 X |
| 4,294,394 | 10/1981 | Iida et al. | 228/158 |
| 4,706,871 | 11/1987 | Kajiwara et al. | 228/158 |
| 4,721,241 | 1/1988 | Yuasa et al. | 228/5.7 |
| 4,973,089 | 11/1990 | Wheeler et al. | 228/170 |
| 5,075,953 | 12/1991 | Braud | 72/202 X |
| 5,121,873 | 6/1992 | Sekiya et al. | 29/527.7 X |
| 5,145,102 | 9/1992 | Minato et al. | 228/125 |
| 5,205,471 | 4/1993 | Kinose et al. | 29/527.7 X |
| 5,212,856 | 5/1993 | Di Giusto et al. | 29/527.7 X |

*Primary Examiner*—Kenneth J. Ramsey
*Attorney, Agent, or Firm*—Webb Ziesenheim Bruening et al.

[57] ABSTRACT

In the continuous manufacture of hot strip material, slabs are produced by a pair of continuous casters and heated to a rolling temperature in a bi-level roller hearth furnace. Hot slabs are discharged from the bi-level furnace alternately from its upper and lower roller hearths. The slabs are then scarfed to clean oxide scale from both sides and to heat the slabs to a temperature of about 2300° F. The scarfed ends of adjacent slabs are overlapped and passed through a two high slab mill welder wherein the overlapped ends are joined together. The joined slabs are thereafter finish rolled to strip gauge in a continuous multi-stand hot strip mill.

18 Claims, 4 Drawing Sheets

METHOD AND APPARATUS FOR CONTINUOUSLY HOT ROLLING STRIP

BACKGROUND OF THE INVENTION

The present invention relates generally to the production of hot rolled steel products and, more particularly, to a method and apparatus for producing hot strip material. The present invention further includes a novel, bi-level roller hearth furnace for heating discrete slabs received from two continuous slab casters. Still further, the invention relates to a method and apparatus for welding successive slabs together after exiting the two level furnace for subsequent continuous hot rolling to finished strip gauge.

It is well-known in the art to continuously roll hot strip by first continuously casting a strand of steel in one or more casters. The strand or strands are conventionally cut to a desired slab length downstream from the caster whereupon they enter a roller hearth or walking beam furnace for heating to a rolling temperature. The slabs leave the furnace and, depending upon the thickness, may then be reduced further in thickness in one or more roughing mills.

In order to provide a continuous length of metal to the hot strip mill, successive rough rolled slabs are end cropped and welded together, conventionally by butt welding the leading end of a trailing slab to the trailing end of a succeeding slab. A plurality of joined slabs are then continuously hot rolled to a desired strip thickness in a tandem hot strip finishing mill comprising a train of six or more mill stands. Heretofore, on-the-fly welding of slabs has caused problems due to poor welding strength, scale defects and/or thickness variations which produce later rolling defects in the strip. Welding on the fly also requires the creation of a buffer zone or extra space to accommodate the slow butt welding process relative to the speed of the mill. In addition, in order to run a conventional, continuous hot strip mill at high efficiencies, it is necessary to run more than one continuous slab caster. This is well-known in the art since the slab yield from one continuous caster is much less than the continuous hot strip mill rolling capacity.

When more than one continuous caster is employed to produce slabs for a hot strip mill, the handling of the slabs in the conventional pre-heat furnaces becomes a problem. Oftentimes, additional furnaces or much larger furnaces are required and/or transfer car systems must be employed in moving slabs laterally from a caster to an in-line or off-line furnace. Naturally, such larger capacity and/or additional furnaces and slab handling apparatus add considerable capital expense to the cost of the mill. Operating costs are also increased due to the additional fuel requirement in firing these extra and/or larger furnaces.

The present invention solves the problems heretofore encountered in the manufacture of continuous hot strip by providing a method and apparatus for heating slabs delivered from a plurality of continuous casters and for joining the slabs on the fly prior to rolling in a continuous hot strip finishing mill. Still further, the invention includes a furnace and an on-the-fly welding apparatus which provides nearly homogeneous temperature throughout the length of the welded transfer bar, precluding the need for so-called "zoom" or accelerated rolling in the hot strip mill. This leads to economies in mill motor sizing and electrical energy demands in running the hot strip mill.

SUMMARY OF THE INVENTION

The present invention is directed to apparatus and a method for the manufacture of continuous hot strip. Briefly, according to the invention, at least two continuous slab casters supply slabs of a predetermined length to a bi-level or double deck, roller hearth furnace. A first continuous caster supplies slabs to a lower roller hearth of the furnace while the second caster supplies slabs to an upper roller hearth of the furnace. The slabs move along the upper and lower levels of the double deck, roller hearth furnace and are heated to a desired rolling temperature therein. A slab scarfer is located downstream from a discharge end of the furnace. A two high slab mill is positioned downstream from the scarfer, followed by a scale breaker, a multi-stand tandem hot strip finish mill and one or more coilers. Flying shears are also provided ahead of the finish mill to crop off a leading edge of the transfer bar and also after the finish mill to cut the finished strip to desired lengths for coiling.

A tiltable, motorized roller table or other means is positioned intermediate the scarfer and the slab mill to overlap the ends of adjacent slabs prior to entry into the slab mill. The overlapped ends of the slabs pass through the rolls of the slab mill and are pressure/fusion welded together therein.

In operation, a first slab delivered from the upper roller hearth of the hi-level furnace, passes through the scarfer. The flames from the gas fired scarfer directly impinge upon the slab to clean oxide scale from both sides and ends of the slab. A second slab is delivered from the lower roller hearth of the furnace trailing the first slab and is also scarfed on both sides and ends. In addition to cleaning oxide scale from the slabs, the scarfing operation raises the temperature of the slabs to about 2,300° F. As the tail end of the leading slab leaves the scarfer, the tiltable roller table is raised and the rolls of the roller table are accelerated to cause the head end of the second, trailing slab to overtake and overlap the tail end of the leading slab. Fluxes may also added to the overlapped slab surface to ensure that the welded zone is oxide free. The pressure applied by the rolls of the slab mill coupled with the elevated temperature resulting from the scarfing treatment causes the overlapped slab ends to be hot pressed/fusion welded as the overlapped slab ends are reduced in cross-section to the original thickness of the individual slabs. A typical slab thickness may be on the order of about 60 mm (2.36"), for example. A pinch roll finishing descaler is preferably positioned downstream from the slab mill welder to clean both sides of the joined slabs prior to entry into the continuous hot strip mill. Additional slabs from the top and bottom levels of the furnace are alternately delivered and subsequently joined to the tail end of a previously joined slab and the process is repeated for as long as needed.

The bi-level or double deck roller hearth furnace, according to one presently preferred embodiment of the invention, comprises upper and lower roller hearths which are vertically spaced apart in substantially parallel, horizontal planes extending along the length of the furnace. A section of the roll table of the upper hearth slopes downwardly to the lower hearth toward the discharge end of the furnace such that the slabs from the upper and lower roller hearths exit the furnace on a common lower roller table. Pivoting pinch rolls are provided at top and bottom locations of the sloped section of the upper hearth to insure controlled movement of the slabs thereon.

In a further embodiment of the bi-level roller hearth furnace, the roll table of the lower hearth lies entirely in a horizontally extending plane while the roll table of the upper hearth lies in a plane which gradually slants downwardly from the inlet to the outlet ends of the furnace such that the plane of the upper hearth intersects with the plane of the lower hearth at a location beyond the outlet end.

A still further embodiment of the double deck, roller hearth furnace includes the above-described, vertically spaced-apart upper and lower roller hearth levels which extend in horizontally extending planes the entire length of the furnace. In this embodiment, a section of the furnace adjacent the discharge end is hinged to permit tilting in a downward direction to permit slabs on the upper roller hearth to be transferred to the roller table at the discharge end. Pivotal movement of the tilting furnace section is accomplished by a hydraulic piston which reciprocally moves a roller support along a bottom portion of the furnace downstream from a hinge member which pivotally connects the tilting section to the stationary section of the furnace. Retraction of the hydraulic piston causes upstream movement of the roller support which, in turn, permits the tilting section to pivot downwardly. Extension of the piston results in downstream movement of the roller support and consequent upward movement of the tilting furnace section. Such upward movement causes the plane of the lower roller hearth in the tilting section to raise and to become aligned with the horizontal plane of the roller table adjacent the discharge end of the furnace.

These, as well as other features and advantages will become more apparent when reference is made to the drawings taken with the following detailed description of the invention.

DETAILED DESCRIPTION OF THE INVENTION

Figure 1:
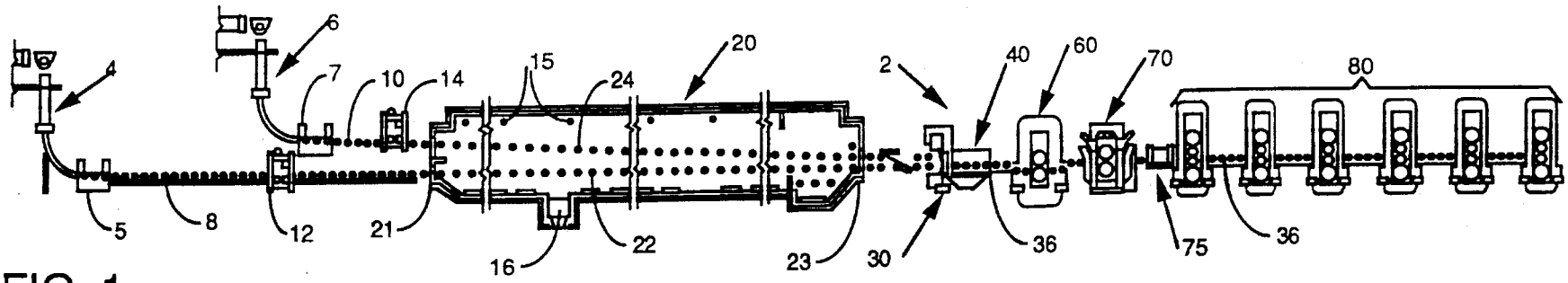
FIG. 1 is a side elevational view of a facility for the production of continuous hot strip including one presently preferred embodiment of slab furnace and slab welder of the invention.

A continuous hot strip mill layout according to the invention, generally designated 2, is depicted in FIG. 1. The continuous hot strip mill 2 includes first and second continuous slab casters 4 and 6, respectively. First caster 4 is located upstream of the second caster 6 and is positioned at a vertical elevation lower than the second caster. Thus, the run out roll table 8 of the first caster 4 is positioned beneath the run out roll table 10 of the second caster 6. A strand of steel is continuously cast and withdrawn from each of the casters 4 and 6 by pinch roll machines 5 and 7 which propel the strand at a proper speed from the casters and along the roll tables 8 and 10, respectively where cooling takes place. Hydraulic shears 12 and 14, located along the roll tables 8 and 10, respectively, cut the continuous strands of steel to discrete slab lengths of a desired dimension. A typical slab may, for example, have a cast thickness of about 60 mm (2.36") and a width of about 1.8 m (6 feet) and a sheared length of about 107 meters (350 feet). Typical slab movement is 12 meters per minute (40 ft./min.)

The discrete slabs proceed in the downstream direction from the shears along the respective lower and upper roll tables 8 and 10 to enter a hi-level or double deck roller hearth furnace, generally designated 20, at an inlet end 21 thereof. The furnace 20 maintains the slabs at a prescribed rolling temperature which, for example, may be greater than 1093° C. (2000° F.). The furnace includes vertically spaced lower and upper roller hearths 22 and 24 which transport slabs from the roll tables 8 and 10, respectively, for heating prior to finish rolling. The furnace 20 is heated conventionally by firing through burner parts 15. Furnace gases are withdrawn from the furnace by way of a plurality of flues 16 and the gases are preferably treated in regenerators or the like (not shown) to improve the heating efficiency thereof.

Heated slabs exit the furnace 20 at discharge end 23 thereof and then pass through a scarfer 30. The flames of the scarfer impinge on both the upper and lower sides of the slabs as well as their ends. The scarfing operation not only removes scale from the slabs but also raises the temperature of the slabs to about 1260° C. (2300° F.).

A slab overlapping device, generally designated 40, the functioning of which will be explained in greater detail hereinafter, overlaps the ends of adjacent slabs just prior to entry into a two-high slab mill welder 60. The two work rolls of the slab mill welder are spaced apart a distance substantially equal to the thickness of the cast slabs. The overlapped slab ends are welded together in a hot pressed/rolled fusion weld due to the high rolling pressure delivered by the rolls of the slab mill welder and the high temperature generated in the scarfing operation.

A flying shear 70 cuts a portion from the head end of the leading slab prior to entry into a finishing scale breaker 75. The scale breaker removes mill scale from the joined slabs, or welded transfer bar, prior to entry into a multi-stand, continuous finishing hot strip mill 80. The finishing mill 80 depicted in FIG. 1 includes six mill stands, but it will be understood that the finishing hot strip mill may contain more or less stands without departing from the scope of the invention.

Additional trailing slabs are welded to the leading transfer bar in the slab mill welder 60 to extend the length of the transfer bar and the resultant length/weight of the finished strip to a desired amount. The above-described slab welding operation occurs on the fly and simultaneously proceeds along with the strip rolling operation in the continuous finishing mill 80. Hot strip material of a desired finish gauge exits the last stand of the mill 80 and is run out on a downstream roll table for cooling and coiling on a conventional coiling apparatus (not shown) comprising, for example, one or more downcoilers. A second flying shear (not shown) similar to flying shear 70 is also located downstream from the strip mill 80, ahead of the coiler(s), to cut the finish rolled strip into desired lengths for subsequent coiling into coils of predetermined size and weight.

Figure 2:
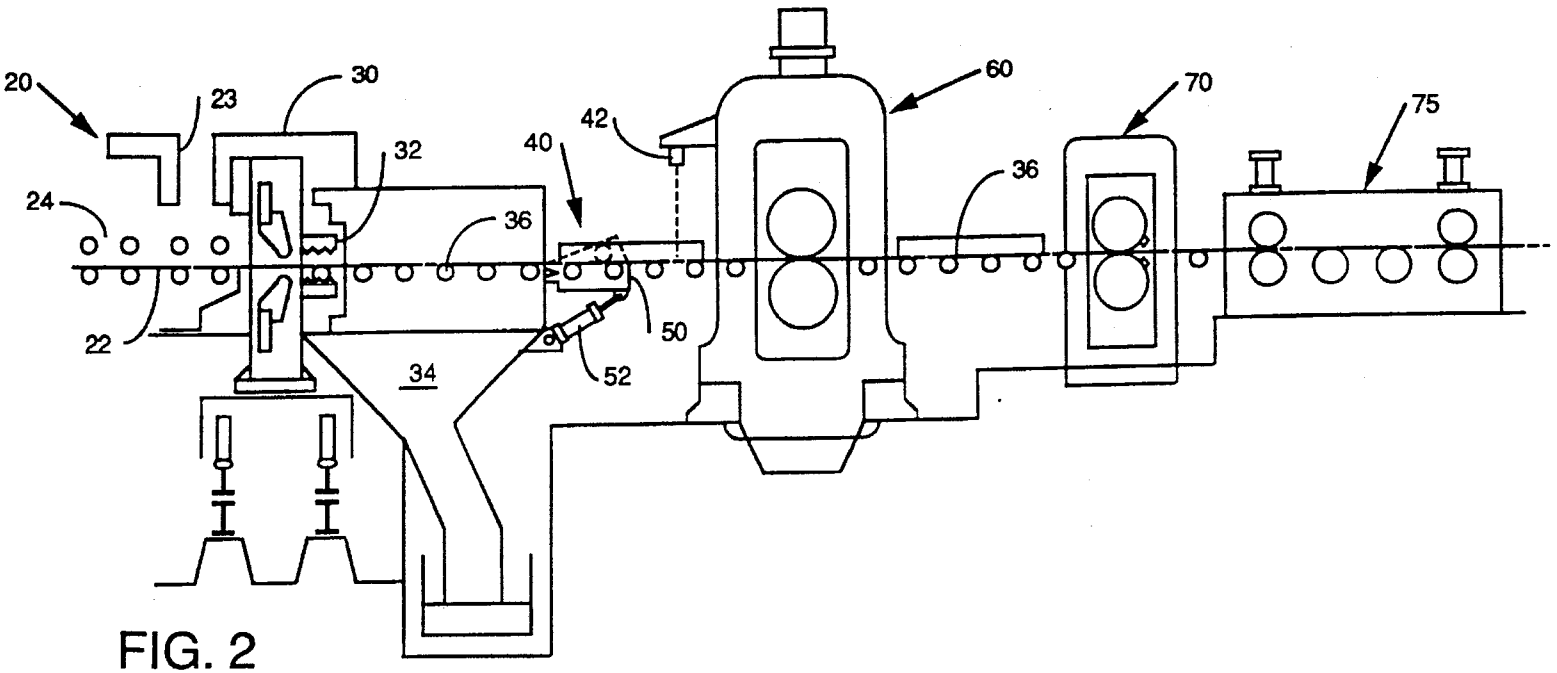
FIG. 2 is an enlarged side elevational view of the slab overlapping device and slab welder of the invention.

The slab overlapping operation is perhaps better understood with reference to FIG. 2. As previously described, slabs are heated in the bi-level roller hearth furnace 20. Hot slabs are delivered alternately from the upper roller hearth 24 and lower roller hearth 22 to the scarfer 30 for further intense heating and descaling. It is of particular importance that all of the oxide bearing scale be removed from the ends of the slabs that are to be welded so as to insure a defect-free fusion weld. In order to enhance the cleanliness of the weld joint, a welding flux is preferably applied to the ends of the slabs prior to welding by a flux application device 32 associated with the scarfing apparatus. A scale pit 34 is provided immediately downstream from the scarfer 30 to collect loose scale which is removed from the slabs by the scarfing torches. A roll table 36 extends in a horizontal plane from the discharge end of the furnace 20 through the continuous hot strip mill 80 to provide a continuous horizontal pathway for the slabs, welded transfer bar and subsequent rolled strip from the furnace 20 to the finish coiler(s). The plane of the roll table 36 is thus coincident with the pass line of the mills 60 and 80.

A hot metal detector, such as detector 42, senses the presence of hot slabs or transfer bars at various locations along the roll table 36 to assist in accurately timing the activation of the mill components. In a start-up mode of operation, a first slab is delivered from the upper roller hearth 24 to the roll table 36. The specific operation of the furnace slab delivery to the roll table varies with the several embodiments of the double deck furnaces 20 disclosed herein and each will be discussed in greater detail hereinafter.

As the tail end of the upper slab reaches the discharge end 23 of the furnace 20, the trailing slab on the lower hearth 22 is accelerated by the rollers of the lower hearth in order to bring the head end thereof in close proximity to the tail end of the first slab. As the tail end of the first slab passes through the scarfer 30 and is scarfed on both sides to clean off scale and further heated, the leading end of the trailing slab also passes through the scarfer and is, likewise, scarfed on both sides. After the passage of the trailing end of the first slab through the hot metal detector 42, the slab overlapping device 40, which includes a tiltable roll table 50, is activated by a hydraulic cylinder 52 which tilts the roll table 50 out of the plane of roll table 36. The upwardly raised roll table 50 raises the head end of the trailing slab above the trail end of the leading slab. The motorized rolls of the device 40 are then accelerated to cause the head end of the trailing slab to overtake and overlap the tail end of the leading slab. The tiltable roll table 50 is lowered and the overlapped slab ends are then passed through the two high slab mill welder 60. As previously described, the pressure of the slab mill welder causes the lapped slab ends to be joined by fusion welding such that the welded joint assumes a thickness equal to the original cast slab thickness. The leading end of the first slab is cropped by the flying drum shear 70. Due to the fact that the length of a slab may be greater than the distance between the shear 70 and slab mill welder 60, the shearing may occur prior to the welding operation. The welded slabs form a long transfer bar which then passes into the descaler 75 for cleaning on both sides to preclude scale particles from being rolled into the strip in the subsequent rolling in the finishing mill 80.

Figure 3:
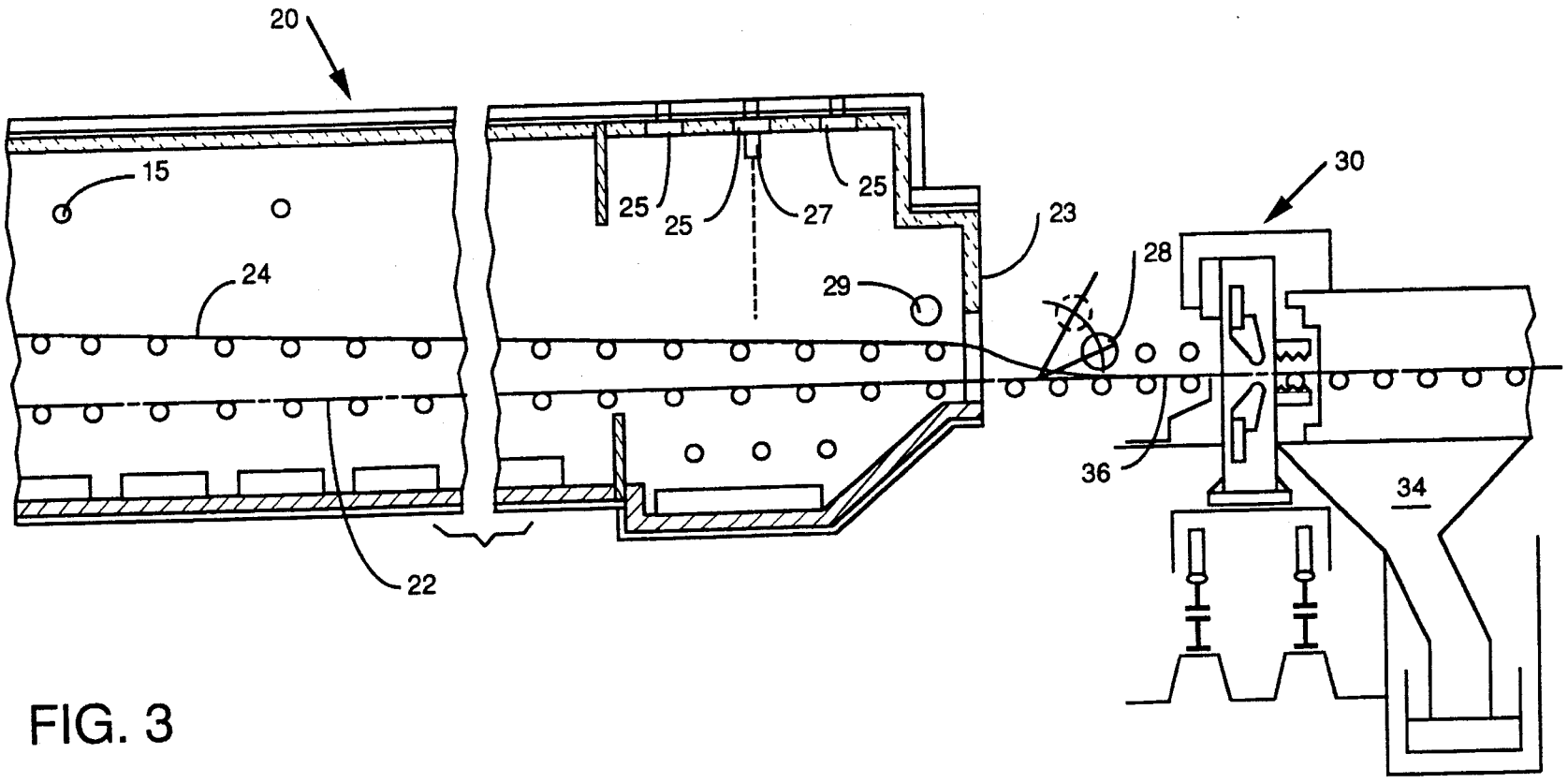
FIG. 3 is an enlarged, partially fragmented, side elevational view of a discharge end of one presently preferred embodiment of a bi-level or double deck roller hearth furnace in accordance with the invention and a scarfer positioned downstream thereof.

A first presently preferred embodiment of the bi-level roller hearth furnace 20 is depicted in FIGS. 1 and 3. In this embodiment, the lower roller hearth 22 lies in a horizontal plane extending from the charge end 21 to the discharge end 23. The upper roller hearth 24 lies in a plane which is oblique relative to the plane of the lower roller hearth 22 such that the plane of the upper roller hearth slopes in a downward direction from the charge end to the discharge end 23 to intersect the plane of the lower roller hearth at a location downstream from the discharge end of the furnace 20. The area of the furnace adjacent the discharge end 23 may contain additional burners 25 in the roof thereof. Three pairs of such burners 25 may be employed to supply additional heat at the open discharge end of the furnace. A hot metal detector 27 is also located adjacent the discharge end 23 to sense the position of slabs on the upper roller hearth 24. A pivoting pinch roll 28 is positioned immediately downstream from the discharge end of the furnace 20 to direct a slab from the upper roller hearth 24 onto the roll table 36. A stationary tailing roll 29 is located immediately upstream from the discharge end 23 and positioned above the upper roller hearth 24. The tailing roll engages the slab as it exits the furnace 20 and maintains the slab at a proper oblique relationship relative to the plane of roll table 36 so that the slab is properly received on roll table and does not cobble between the rolls of the roll table 36. The slab from the upper roller hearth 24 is delivered to the roll table 36 and the tail end of the slab is subsequently overlapped by the head end of a tailing slab delivered from the lower roller hearth 22, as previously described in connection with FIG. 2. By way of example, the longitudinal, axial spacing of the rolls in the lower and upper roller hearths 22 and 24 is on the order of about one meter (39") with the overall length of furnace 20 from the charge end to the discharge end being about 244 meters (800 feet).

Figure 4:
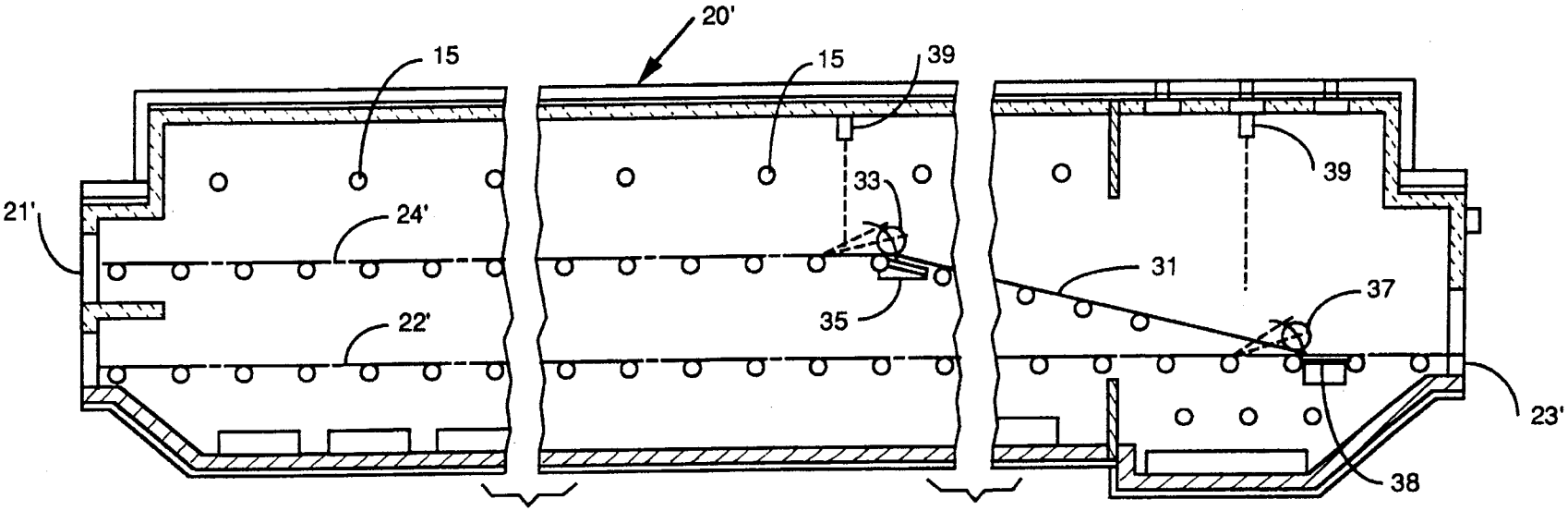
FIG. 4 is a partially fragmented, side elevational view of another presently preferred embodiment of a double deck roller hearth furnace of the invention.

A further presently preferred embodiment of a bi-level furnace according to the present invention is identified by reference numeral 20' in FIG. 4. The lower roller hearth 22' extends in a horizontal plane from the charge end 21' to the dischrage end 23' of the furnace as in the previously described embodiment. The upper roller hearth 24' lies in a horizontal plane spaced above the lower roller hearth, the horizontal plane extending from the charge end to a point approaching the discharge end. At that location, the upper roller hearth has a sloped roller table 31 extending downwardly from the upper hearth to the lower roller hearth 22'. A first pivoting pinch roll 33 is positioned at the downstream end of the horizontal upper roller hearth 24' located above a first bottom guide plate 35 to deflect and guide slabs from the horizontal roller hearth 24' to the sloped roller table 31. A second pivoting pinch roll 37 and second bottom guide plate 38 are located at the lower end of the sloped roller table 31 to controllably guide the slabs to the lower roller hearth 22' for exiting the furnace 20' at the discharge end 23'. One or more hot metal detectors 39 are deployed in the furnace 20' to monitor the positions of the slabs for proper control of the process. After discharge from the furnace 20', the slabs are overlapped and welded as previously described.

Figure 5:
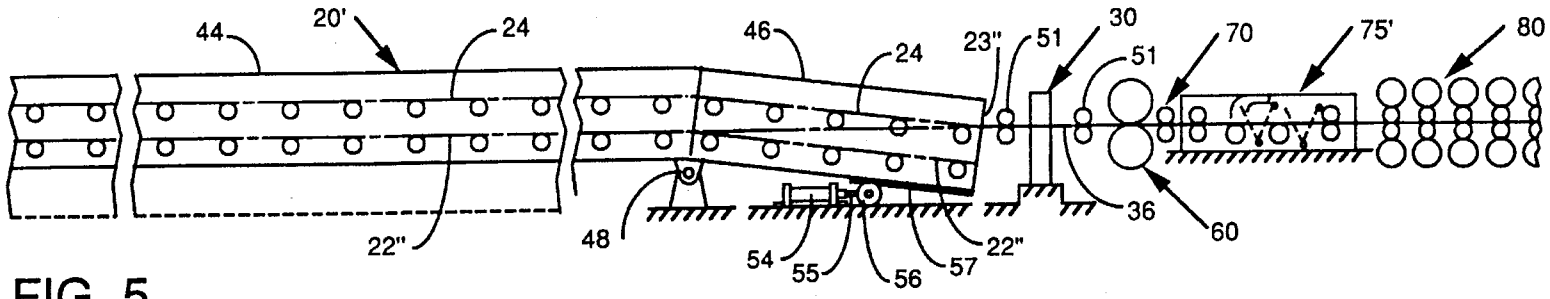
FIG. 5 is a partially fragmented side elevational view in schematic of a tiltable, double deck roller hearth furnace according to a further embodiment of the present invention.
Figure 6:
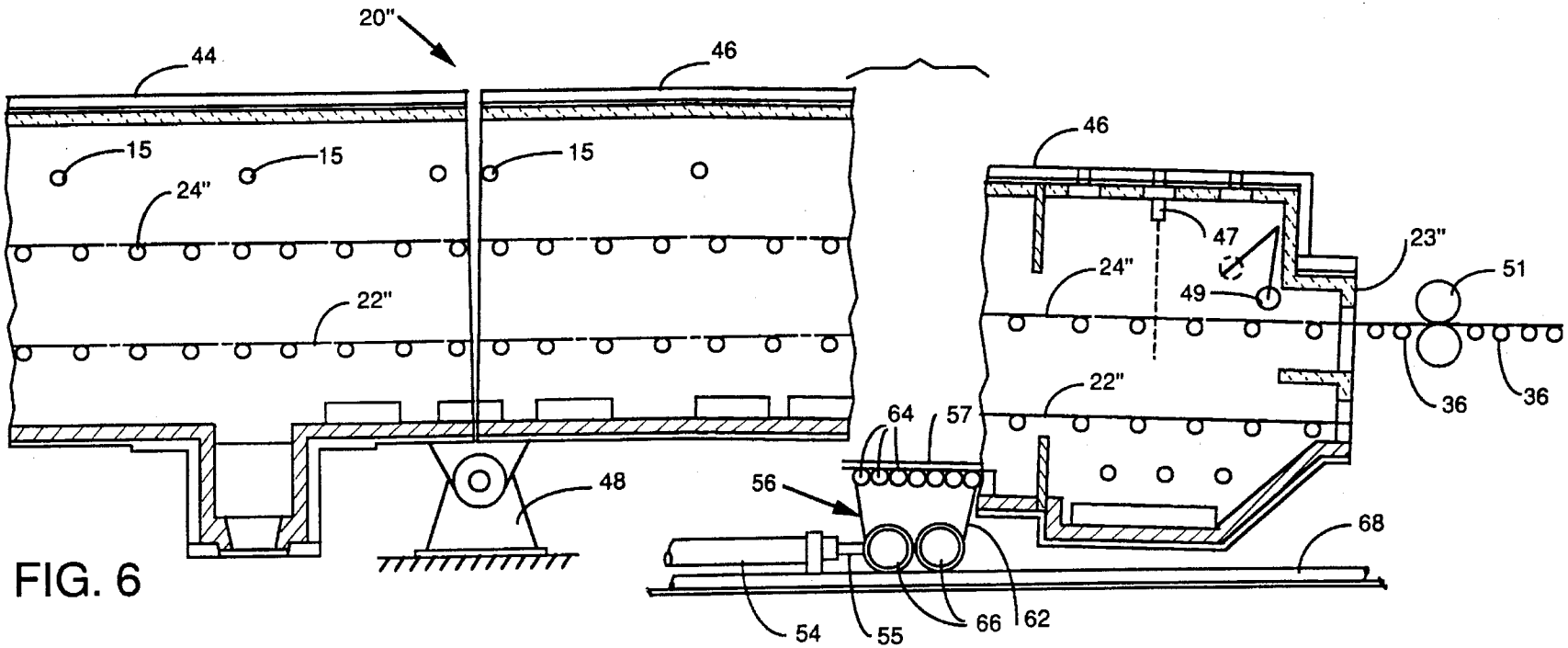
FIG. 6 is an enlarged, partially fragmented, side view of the tiltable furnace of FIG. 5.

A still further embodiment of a bi-level furnace according to the invention is shown in FIGS. 5 and 6 and identified generally by reference numeral 20". As in the previously described embodiments, the furnace 20" receives slabs from two continuous caster at an upstream charge end for heating to a finish rolling temperature and subsequent delivery at a discharge end 23". Furnace 20" includes a lower roller hearth 22" and an upper roller hearth 24" for curing slabs from the two casters for alternate delivery to the roll table 36.

The roller hearth furnace 20" includes upper and lower roller hearths 24" and 22" which lie in vertically spaced-apart, horizontal planes extending from the charge end of the furnace to the discharge end thereof. The furnace 20" further comprises a stationary furnace section 44 and a tilting furnace section 46. The tilting furnace section 46 is pivotally connected to the stationary furnace section 44 by a hinge element 48 so as to permit vertical movement of the tilting furnace section 46 between a horizontal position and a tilted position. In the horizontal position, the lower roller hearth 22" is coincident with the plane of the roll table 36 so that slabs from the lower roller hearth can be delivered to the roll table 36. In the tilted portion, as shown in FIGS. 5 and 6, the tilting furnace section 46 is pivoted downwardly about the hinge 48 a distance such that the plane of the upper roller hearth 24" in the tilting furnace section 46 intersects with the plane of the roll table 36 to permit hot slabs from the upper roller hearth to be delivered to the roll table 36.

Pivotal movement of the tilting furnace section 46 about the hinge element 48 is accomplished by a hydraulically actuated device 54 including an extensible and retractable piston rod 55. The piston rod carries a slide element 56 at a distal end for sliding engagement with a track or like engaging surface on a bottom wall 57 of the tilting furnace section 46. The slide element 56 is shown in greater detail in FIG. 6 and may comprise a frame 62 which carries a plurality of rollers 64 at the top thereof for engagement with the bottom wall 57 of the tilting furnace section. The frame 62 also has a pair of wheels 66 rotatably mounted thereto for movement along a trackway formed by rails 68. Thus, the slide element 56 bears a substantial portion of the weight of the tilting furnace section 46 and functions to raise the furnace section 46 as the piston rod 55 of the hydraulically actuated device 54 is extended and to lower the furnace section 46 when the piston rod 55 is retracted.

The furnace 20" also includes one or more hot metal detectors 47 and a pivoting pinch roll 49 adjacent the discharge end 23" to control the delivery of slabs from the upper roller hearth 24" in the downwardly sloped, tilting furnace section 46.

In operation, as soon as the front end of a top slab delivered from the upper roller hearth 24" enters the slab mill welder 60, the tilting furnace section 46 is raised to the horizontal position as previously described and the tail end of the tip slab rolls off the discharge end of the upper roller hearth 24" in a slight ogee curve onto the roll table 36 which is coincident with and defines the plane of the mill pass line. Pinch rolls 51 may be employed to control the movement of slabs along the roll table 36. As the tail end of the top slab approaches the discharge end 23" of the furnace as sensed by the hot metal dector(s) 47, a bottom slab on the lower roller hearth 22" is accelerated to permit the head end of the bottom slab to catch up with the tail end of the top slab. This acceleration step may be implemented as soon as the flying shear 70 cuts the leading edge of the top slab. As the tail end of the top slab passes through the scarfer 30 and is scarfed on both sides, the head end of the bottom slab also passes through the scarfer and is scarfed on both sides. The head end of the bottom slab is then raised either by a tiltable roll table 50 or by raising the tilting furnace section 46 to a position above horizontal whereby the head end of the bottom slab is above the tail end of the top slab. The bottom slab is then accelerated to overlap the tail end of the leading top slab as the overlapped slabs then proceed through the slab mill welder 60. The welded slabs then pass through a pinch roll finishing descaler 75" or like finishing scale breaker to clean both sides of the welded slabs or transfer bar prior to entry into the continuous hot strip mill 80 for finish rolling into coiled hot strip. The entire process described above may be endlessly repeated as described to form a continuous strip of, for example, 3000 P.I.W. in finished coil form.

Located downstream from the hot strip mill 80 is a conventional run out table, flying shear and strip coilers (not shown). The downstream flying shear cuts the continuous finsih gauge strip to desired lengths which are then coiled to form coils of desired weight and size. Typical finish strip gauge is between 1/16" to 3/8" in thickness with coil widths ranging between 50"–80".

While specific embodiments of the invention have been described in detail, it will be appreciated by those skilled in the art that various modifications and alternatives to those details could be developed in light of the overall teachings of the disclosure. The presently preferred embodiments described herein are meant to be illustrative only and not limiting as to the scope of the invention which is to be given the full breadth of the appended claims and any and all equivalents thereof.

What is claimed is:

1. Apparatus for continuous manufacture of hot rolled strip comprising:

continuous casting means for producing slabs;

furnace means for heating the slabs to a rolling temperature;

scarfing means to further heat the slabs upon discharge from the furnace means;

means for overlapping a head end of a trailing slab and a tail end of a leading slab or a transfer bar, including means for raising the head end of the trailing slab and for accelerating the trailing slab, whereby, the head end of the trailing slab overlaps the tail end of the leading slab or transfer bar;

slab mill means for hot rolling said scarfed and overlapped slab ends to fusion weld said ends together to form a welded transfer bar; and hot strip mill means to finish roll the welded transfer bar to a finish strip gauge.

2. The apparatus of claim 1 wherein the means for raising the head end of the trailing slab comprises a tiltable roll table means positioned between said scarfing means and said slab mill means.

3. The apparatus of claim 1 wherein the means for raising the head end of the trailing slab comprises a tilting furnace section means at the discharge end of the furnace means.

4. Apparatus for the manufacture of continuous hot strip material comprising:

a pair of continuous casters for producing steel slabs;

a bi-level roller hearth furnace for heating the slabs to a rolling temperature, said furnace including a lower roller hearth for receiving slabs produced in a first of said pair of continuous casters and an upper roller hearth for receiving slabs produced in a second of said pair of continuous casters;

a scarfer positioned downstream from a discharge end of said bi-level roller hearth furnace for cleaning and heating said slabs;

means for overlapping ends of adjacent slabs;

a slab mill welder for rolling the overlapped ends of adjacent slabs to weld said slabs together to form a transfer bar;

a first flying shear means to crop off a leading end of the transfer bar;

means for descaling the transfer bar;

a multi-stand, tandem hot strip mill for rolling the transfer bar to a finished strip;

a second flying shear means for cutting the strip to predetermined lengths; and coiler means for coiling the cut lengths of strip produced in the hot strip mill.

5. The apparatus of claim 4 including means for applying flux to the overlapped stab ends prior to entry into the slab mill welder.

6. The apparatus of claim 4 wherein the slab mill welder is a two high slab mill.

7. A method of manufacturing continuous hot strip material comprising the steps of:

(a) providing a pair of continuous slab casting machines;

(b) casting two strands of material from said pair of casting machines and thereafter cutting said strands into discrete slabs;

(c) providing a bi-level roller hearth furnace having an upper roller hearth and a lower roller hearth longitudinally extending from a charge end to a discharge end of said furnace;

(d) heating slabs from a first of said pair of continuous slab casting machines along the lower roller hearth while concurrently heating slabs from a second of said pair of continuous slab casting machines along the upper roller hearth;

(e) discharging heated slabs alternately from said upper and lower roller hearths;

(f) scarfing said slabs to clean and further heat said slabs;

(g) overlapping ends of adjacent slabs;

(h) rolling said overlapped ends in a slab mill welder to join the adjacent slabs together; and (i) finish rolling said joined slabs in a continuous hot strip mill to a finish strip gauge.

8. The method of claim 7 including the step of applying a welding flux to said overlapped ends prior to the rolling step in the slab mill welder.

9. A method of joining slabs in the manufacture of continuous hot strip comprising:

providing a plurality of hot slabs;

heating at least end portions of each of said slabs;

overlapping said heated end portions of an adjacent pair of slabs;

rolling said overlapped slabs to join said slabs together by pressure fusion welding.

10. The method of claim 9 wherein said heating of the end portions includes scarfing said slabs.

11. The method of claim 9 including the step of adding a flux to said end portions prior to the rolling step.

12. The method of claim 9 wherein the joined end portions after said rolling step have a thickness substantially the same as an original slab thickness prior to rolling.

13. The method of claim 9 wherein the hot slabs are provided by a continuous casting means.

14. A furnace for heating slabs supplied from a plurality of continuous casting machines for delivery to a continuous hot strip mill comprising:

a furnace enclosure having a charge end and a discharge end;

means for heating said enclosure;

a lower roller hearth for supporting slabs through the furnace longitudinally extending along a horizontal plane within said furnace enclosure from the charge end to said discharge end; and an upper roller hearth for supporting slabs through the furnace vertically spaced above said lower roller hearth and longitudinally extending between the charge and discharge ends.

15. The furnace of claim 14 wherein at least a major portion of said upper roller hearth extends in a horizontal plane.

16. The furnace of claim 14 wherein the upper roller hearth includes a discharge end portion lying in an inclined plane which intersects with the horizontal plane of the lower roller hearth.

17. The furnace of claim 14 wherein said upper roller hearth lies in an inclined plane which converges toward the plane of said lower hearth adjacent the discharge end of the furnace.

18. The furnace of claim 14 wherein a section of said furnace enclosure at the discharge end is tiltable to permit selective movement of the upper roller hearth to a lower position wherein a plane passing along said upper roller hearth intersects the plane of said lower roller hearth.

* * * * *

UNITED STATES PATENT AND TRADEMARK OFFICE

CERTIFICATE OF CORRECTION

PATENT NO. : 5,490,315

DATED : February 13, 1996

INVENTOR(S) : Peter Kostopolos and Giuseppe Facco

It is certified that error appears in the above-indentified patent and that said Letters Patent is hereby corrected as shown below:

Column 2 Line 22 "hi-level" should read --bi-level--.

Column 2 Line 33 after "also" insert --be--.

Column 3 Line 40 "thereof." should read --thereof;--.

Column 3 Line 66 after "respectively" insert --,--.

Column 4 Line 6 after "min.)" insert --.--.

Column 4 Line 9 "hi-level" should read --bi-level--.

Column 4 Line 31 "two-high" should read --two high--.

Column 6 Line 13 "table and" should read --table 36 and--.

Column 6 Line 29 "dischrage" should read --discharge--.

Column 6 Line 52 "caster" should read --casters--.

Column 7 Line 41 "dector(s)" should read --detector(s)--.

Column 7 Line 66 "finsih" should read --finish--.

UNITED STATES PATENT AND TRADEMARK OFFICE

CERTIFICATE OF CORRECTION

PATENT NO. : 5,490,315
DATED : February 13, 1996
INVENTOR(S) : Peter Kostopolos and Giuseppe Facco It is certified that error appears in the above-indentified patent and that said Letters Patent is hereby corrected as shown below:

Claim 5 Line 66 Column 8 "stab" should read --slab--.

Claim 9 Line 36 Column 9 after "slabs;" insert --and--.

Claim 16 Line 27 Column 10 "14" should read --15--.

Signed and Sealed this

Fourth Day of June, 1996

*Attest:*

Bruce Lehman

BRUCE LEHMAN

*Attesting Officer*

*Commissioner of Patents and Trademarks*